United States Patent [19]

Sanchez et al.

[11] Patent Number: 5,016,713

[45] Date of Patent: May 21, 1991

[54] METHOD OF PREHEATING A HEAVY OIL ZONE THROUGH EXISTING BOTTOM WATER AND THEN DIVERTING STEAM INTO THE OIL ZONE

[75] Inventors: J. Michael Sanchez; E. Thomas Strom, both of Dallas, Tex.

[73] Assignee: Mobil Oil Corporation, Fairfax, Va.

[21] Appl. No.: 493,259

[22] Filed: Mar. 14, 1990

[51] Int. Cl.[5] ..... E21B 33/138; E21B 43/22; E21B 43/24

[52] U.S. Cl. ..... 166/270; 166/272; 166/273; 166/288; 166/295; 166/297

[58] Field of Search ..... 166/270, 272, 288, 294, 166/295, 273, 274, 303, 297

[56] References Cited

U.S. PATENT DOCUMENTS

| | | | |
|---|---|---|---|
| 2,799,341 | 7/1957 | Maly | 166/295 X |
| 3,557,562 | 1/1971 | McLaughlin, Jr. et al. | 166/295 |
| 3,601,195 | 8/1971 | Hearn | 166/288 |
| 3,997,004 | 12/1976 | Wu | 166/251 |
| 4,157,322 | 6/1979 | Colegrove | 166/270 |
| 4,482,015 | 11/1984 | Falk | 166/295 X |
| 4,658,898 | 4/1987 | Paul et al. | 166/270 |
| 4,716,966 | 1/1988 | Shu | 166/295 |
| 4,804,043 | 2/1989 | Shu et al. | 166/288 X |
| 4,903,768 | 2/1990 | Shu | 166/288 X |
| 4,907,656 | 3/1990 | Sanchez et al. | 166/288 X |
| 4,934,456 | 6/1990 | Moradi-Araghi | 166/270 |

*Primary Examiner*—George A. Suchfield
*Attorney, Agent, or Firm*—Alexander J. McKillop; Charles J. Speciale; Charles A. Malone

[57] ABSTRACT

A method for recovering viscous oil from a formation having a bottom water zone below an oil containing zone. Steam is directed into the bottom water zone thereby heating this zone and an oil containing zone thereabove. Afterwards, steam injection is ceased and a gellable composition is directed into the bottom water zone where it forms a solid gel. Once the solid gel has formed, steam is injected into the bottom water zone where the solid gel causes it to flow upwardly into the oil containing zone. Oil, water, and steam are removed via a recompleted producer well.

6 Claims, 1 Drawing Sheet

METHOD OF PREHEATING A HEAVY OIL ZONE THROUGH EXISTING BOTTOM WATER AND THEN DIVERTING STEAM INTO THE OIL ZONE

RELATED APPLICATIONS

This application is related to copending application Ser. No. 068,290 filed July 1, 1987, now U.S. Pat. No. 4,804,043. It is also related to Ser. No. 292,795 which was filed on Jan. 3, 1989, now U.S. Pat. No. 4,940,082. It is further related to Ser. No. 292,799 which was filed on Jan. 3, 1989, now U.S. Pat. No. 4,950,698.

FIELD OF THE INVENTION

This invention relates to the heating of a relatively impermeable formation through steam heating of a bottom water zone and then diverting this steam into overlying oil zones through the action of a solid gel in the bottom water zone.

BACKGROUND OF THE INVENTION

In the recovery of oil from oil-containing formations, it is usually possible to recover only minor portions of the original oil-in-place by so-called primary recovery methods which utilize only natural forces. To increase the recovery of oil a variety of supplementary recovery techniques are employed. These techniques include waterflooding, miscible flooding, thermal recovery, and steam flooding.

A problem that arises in various flooding processes is that different strata or zones in the reservoir often possess different permeabilities. Thus, displacing fluids enter high permeability or "thief" zones in preference to zones of lower permeability. Significant quantities of oil may be left in zones of lower permeability. To circumvent this difficulty the technique of profile control is applied to plug the high permeability zones with polymeric gels and thus divert the displacing fluid into the low permeability, oil rich zones. Among the polymers examined for improving waterflood conformance are metal cross-linked polysaccharides, metal cross-linked polyacrylamides, and organic cross-linked polyacrylamides.

Another problem that arises when steam flooding a formation having a non-aquifer bottom water zone is that on occasion steam channels into the bottom water zone. This bottom water zone has relatively high permeability which allows high steam and water mobility therethrough. It is difficult to re-direct the steam into upper portions of the reservoir or formation since steam prefers the path of least resistance. The path of least resistance in this situation happens to be the bottom water zone.

Therefore, what is needed is a method for preventing steam channelling in a bottom water zone which will allow steam to be re-directed into an upper zone of a reservoir so that hydrocarbonaceous fluids can be removed therefrom.

SUMMARY

This invention is directed to a method for heating a formation through a non-aquifer bottom water zone and the subsequent diversion of steam into a preheated formation viscous oil containing zone.

Steam is first injected into the bottom water zone. Well communication is established with a producer or producers. The bottom water zone is used in lieu of injecting into the viscous oil zone directly due to anticipated injectivity problems. Injection of steam at low quality is continued for a time sufficient to preheat some of the lower and middle parts of the oil zone. When the temperature of the overlying oil zone reaches a desired temperature range, steam injection is temporarily terminated.

Since communication has occurred between the injector and producer wells in the bottom water zone, it is difficult to now redirect steam into the oil zone to give the needed convective heating for oil production. This problem is solved by injecting a gellable composition capable of in-situ polymerization to form polymer gels into the bottom water zone at the producing well. Polymer gels are of a type that can withstand high temperatures. Penetration of this composition into the bottom water zone should be ⅓ to ½ the distance to the injector, depending upon projected economics. The producer well is recompleted above the bottom water zone. Care must be taken not to complete the producer too high above the warmed oil zone. Steam injection into the bottom water is now resumed. However, the bottom water zone is now blocked off. With the blockage of the bottom water zone, steam is redirected upwardly into the warmed oil zone and oil is produced from the same zone at the producer. Gravity aids this process since steam is redirected upwardly.

It is therefore an object of this invention to provide for a gellable composition which can be delivered into a heated bottom water zone having a temperature sufficient to activate said composition and form a solid gel therein.

It is another object of this invention to provide for a composition that will minimize gel damage to an upper productive zone while closing pores in a heated higher permeability bottom water zone.

DESCRIPTION OF THE PREFERRED EMBODIMENTS

Figure 1:
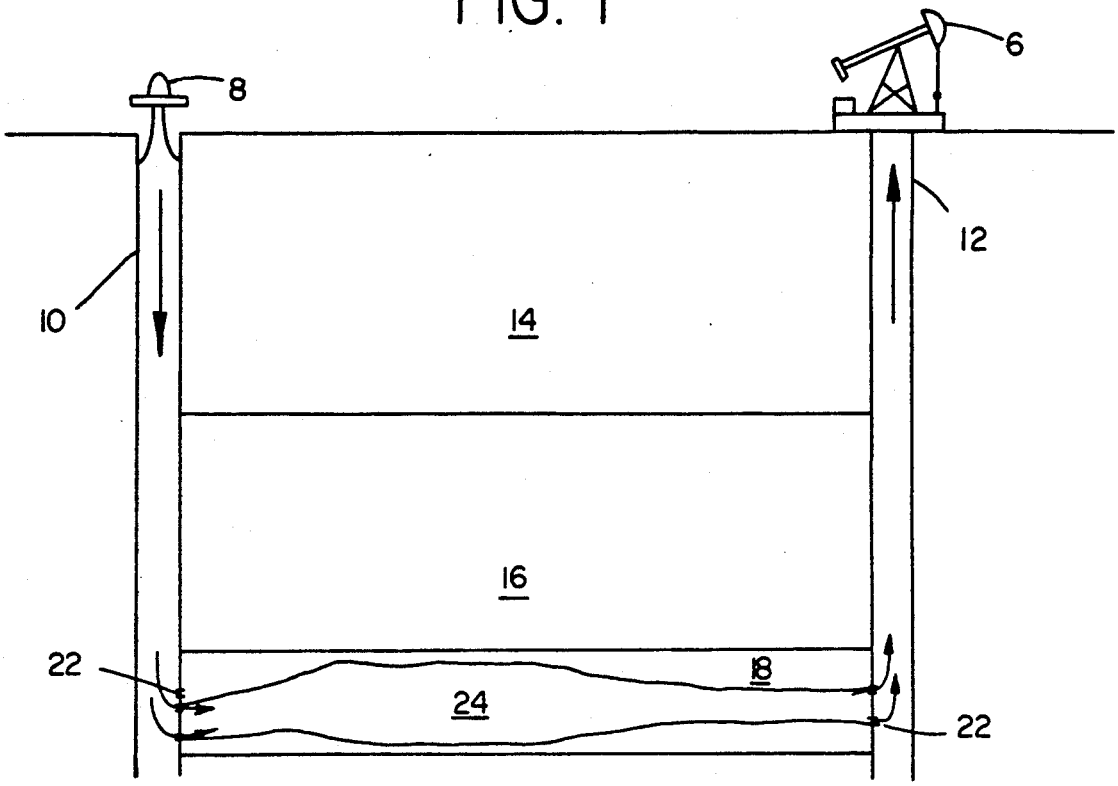
FIG. 1 is a diagrammatic plane view of a formation where steam is passing through a bottom water zone into a production well.

In the practice of this invention, referring to FIG. 1, steam is injected by steam injector 8 into injector well 10. Steam exits injector well 10 via perforations 22 so as to create a steam zone 24 in bottom water zone 18. Steam continues flowing through bottom water zone 18 where the permeability is substantially greater than viscous oil bearing zones 14 and 16. Because bottom water zone 18 has a permeability substantially greater than the permeability of either zone 14 or 16, zone 18 becomes a relatively high steam and water mobility zone. Viscous oil contained in zones 14 and 16 can comprise tar sands. Steam is continually injected into steam zone 24 and exits that zone via perforations 22 into producer well 12.

Steam is injected into bottom water zone 18 for a time sufficient to heat zone 18 to a temperature in excess of about 210° F. Injection of steam into bottom water zone 18 also causes an increase in the temperature of upper formations 14 and 16. Steam injection into bottom water zone 18 is continued until viscous oil contained in zones 14 and 16 becomes mobile. The temperature obtained in zones 14 and 16 or bottom water zone 18 will of course depend upon the steam injection rate, temperature, and pressure of the steam being injected into injector well 10. The longer steam is injected into the formation, the hotter the temperature in zones 14, 16 and 18.

Figure 2:
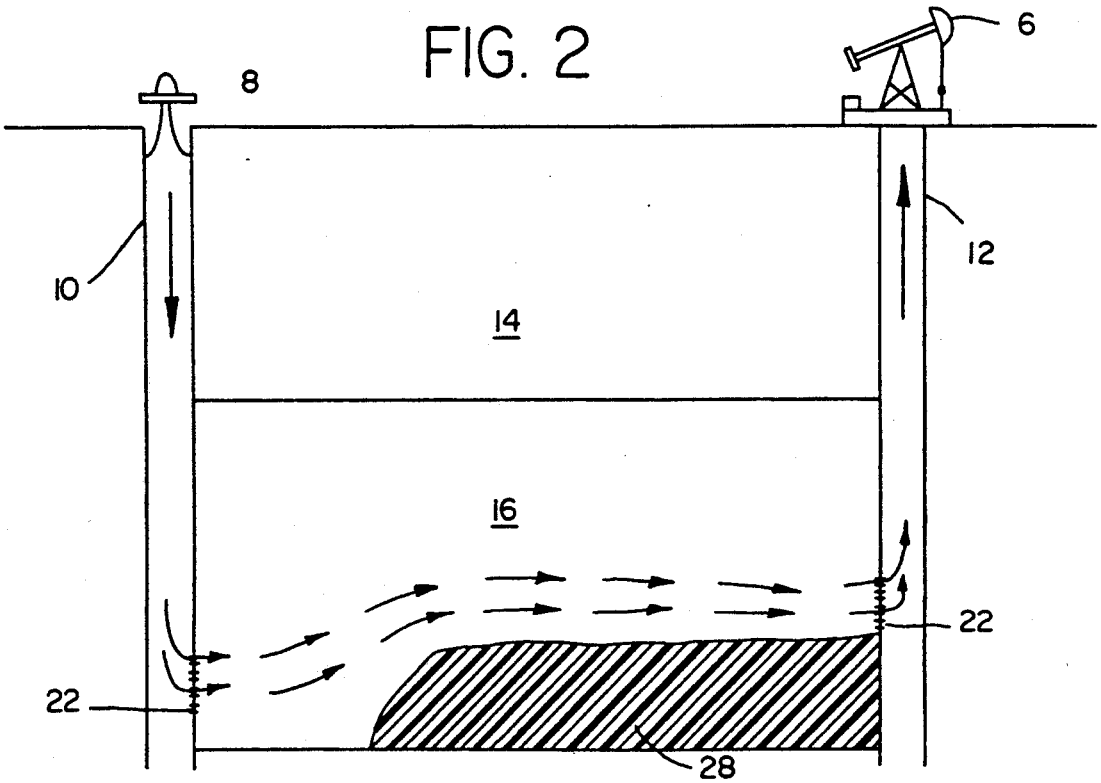
FIG. 2 is a diagrammatic plane view where the lower bottom water zone has been partially closed with a gellable composition while steam is passing through an upper hydrocarbonaceous fluid bearing zone or area.

After obtaining the desired temperature in zones 14 and 16 sufficient to mobilize viscous oil contained therein, steam injection into injector well 10 is ceased. Subsequently, a gellable composition is prepared above ground for injection into heated bottom water zone 18. The gellable composition is formulated so as to allow penetration into the bottom water zone for a distance of about ⅓ to ½ the distance from the injector well thereby blocking off an area substantially near the producer well as is shown in FIG. 2. To accomplish this penetration, a spacer volume of water is utilized. Initiators and retarders or inhibitors can be included into the composition to obtain the desired penetration. Since penetration must be controlled, this method is intended for use in a non-aquifer bottom water zone.

While bottom water zone 18 is of a temperature greater than about 210° F., a gellable composition is injected into bottom water zone 18. The gel is allowed to remain in zone 18 for a time sufficient to form a solid gel 28 as is shown in FIG. 2. The solid gel that forms is capable of withstanding temperatures greater than about 210° F.

Once solid gel 28 has formed steam injection is again commenced into the formation by injector well 10 as before. As is shown in FIG. 2, steam exiting injector well 10 via perforations 22 encounters solid gel 28 and continues to heat oil contained in zone 16.

In order to remove viscous oil from zone 16, producer well 12 is recompleted sufficiently above zone 18 via additional perforations 22 so as to allow fluid communication with zone 16. Steam injected into zone 16 via injector well 10 heats up oil in zone 16 and causes it to flow into producer well 12. Steam injection into zone 16 continues until sufficient oil has been removed from that zone by producer well 12 via pump 6.

There are several gellable compositions which can be used to form a solid gel in zone 18. These include, but are not limited to, an in-situ gellable composition disclosed in U.S. Pat. No. 3,557,562 which contains acrylamide monomer, methylene-bis-acrylamide as an organic cross-linker, and a free radical initiator. This patent is incorporated by reference herein. This system undergoes polymerization in the formation to give a polyacrylamide cross-linked with methylene-bis-acrylamide. However, the viscosity of the solution when injected is like that of water. Mechanical isolation is required since these solutions are quite capable of penetrating low permeability, oil bearing zones.

A polymeric gellable composition is disclosed in U.S. Pat. No. 4,658,898 which issued to Paul and Strom on Apr. 21, 1987. This patent discloses an aqueous solution of heteropolysaccharide S-130 combined with inorganic cations which forms gels at elevated temperatures. U.S. Pat. No. 4,716,966, issued to Shu on Jan. 5, 1988, discloses a gel formed by amino resins such as melamine formaldehyde which modify biopolymers in combination with transitional metal ions. These patents are hereby incorporated by reference herein.

Another gellable composition which can be used herein is disclosed in U.S. Pat. No. 4,834,180 which issued to includes xanthan biopolymers, heteropolysaccharide S-130, poly(acrylamide-co-acrylamido-2-methylpropanesulfonate), and acrylamide modified polyvinyl alcohol. The cross-linker is a partially methylated aminoplast resin which cross-links with the polymer thereby forming a gel in the absence of a salt which is acid generating upon the application of heat. This patent is hereby incorporated by reference herein.

Steamflood processes which can be utilized when employing these gels described above are detailed in U.S. Pat. Nos. 4,489,783 and 3,918,521 issued to Shu and Snavely, respectively. These patents are hereby incorporated by reference herein.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A method for recovering viscous oil from a formation having a bottom water zone therebelow comprising:

(a) injecting steam into said bottom water zone via fluidly communicating injector and producer wells for a time sufficient to heat oil in a zone above said water zone to a temperature sufficient to mobilize said oil;

(b) thereafter injecting into said formation a gellable composition in an amount sufficient to form an in-situ solid gel in said bottom water zone substantially near said producer well;

(c) allowing said composition to remain in said bottom water zone for a time sufficient to form a solid gel thereby blocking said water zone to steam flow therethrough;

(d) perforating the producer well sufficiently above the solid gel so as to cause fluid communication with a heated oil containing zone; and (e) injecting steam into the injection well which steam flows upwardly over said solid gel and removes oil from said heated zone via said producer well.

2. The method as recited in claim 1 where said gellable composition forms a solid gel sufficient to withstand temperatures of from about 200° to about 310° F.

3. The method as recited in claim 1 where a spacer volume of water is used to cause said gellable composition to penetrate the bottom water zone for at least about one third the distance from said injector well.

4. The method as recited in claim 1 where said formation comprises tar sand.

5. The method as recited in claim 1 where the gellable composition contains an initiator and a retarder in an amount sufficient to allow said composition to travel a desired distance into the bottom water zone.

6. The method as recited in claim 1 where the formation contains a non-aquifer bottom water zone.

* * * * *